US010203129B2

(12) United States Patent
Moore et al.

(10) Patent No.: US 10,203,129 B2
(45) Date of Patent: Feb. 12, 2019

(54) AIR DIFFUSER OUTLET SYSTEM

(71) Applicant: McKinstry Co., LLC, Seattle, WA (US)

(72) Inventors: Doug Moore, Seattle, WA (US); Michael Hedrick, Seattle, WA (US); Michael J. Frank, Seattle, WA (US)

(73) Assignee: McKinstry Co., LLC, Seattle, WA (US)

( * ) Notice: Subject to any disclaimer, the term of this patent is extended or adjusted under 35 U.S.C. 154(b) by 1176 days.

(21) Appl. No.: 13/837,984

(22) Filed: Mar. 15, 2013

(65) Prior Publication Data

US 2014/0124165 A1 May 8, 2014

Related U.S. Application Data

(60) Provisional application No. 61/723,380, filed on Nov. 7, 2012.

(51) Int. Cl.

| | |
|---|---|
| ***F24F 13/02*** | (2006.01) |
| ***F24F 13/12*** | (2006.01) |
| ***F24F 13/24*** | (2006.01) |
| ***F24F 7/10*** | (2006.01) |

(52) U.S. Cl.

CPC ..... *F24F 13/0236* (2013.01); *F24F 7/10* (2013.01); *F24F 13/0227* (2013.01); *F24F 13/12* (2013.01); *F24F 13/24* (2013.01)

(58) Field of Classification Search

CPC .... F24F 13/12; F24F 13/0227; F24F 13/0236; F24F 7/10; F24F 13/072

USPC ..... 454/284, 292, 322, 324, 330, 299, 301

See application file for complete search history.

(56) References Cited

U.S. PATENT DOCUMENTS

| | | | | | |
|---|---|---|---|---|---|
| 2,206,119 | A * | 7/1940 | Persons | F24F 3/044 | 165/42 |
| 3,319,558 | A * | 5/1967 | Bodian | E04B 9/02 | 454/296 |
| 3,545,470 | A * | 12/1970 | Paton | B65G 53/56 | 137/101 |
| 3,967,780 | A * | 7/1976 | Traver | F24F 3/0444 | 236/49.4 |
| 4,475,446 | A * | 10/1984 | McCall | F24F 13/072 | 454/304 |
| 5,001,968 | A * | 3/1991 | Sodec | F24F 13/06 | 454/292 |
| 5,358,444 | A * | 10/1994 | Helm | F24F 7/08 | 454/306 |
| 5,368,072 | A * | 11/1994 | Cote | F16K 11/0655 | 137/872 |
| 5,468,184 | A * | 11/1995 | Collier | F24F 7/08 | 454/186 |
| 5,807,171 | A * | 9/1998 | Felsen | F24F 13/06 | 454/296 |

(Continued)

*Primary Examiner* — Steven B McAllister
*Assistant Examiner* — Ko-Wei Lin
(74) *Attorney, Agent, or Firm* — Lowe Graham Jones PLLC

(57) ABSTRACT

An air diffuser having a single air inlet has air outlets straddling a wall of a structure to distribute air to two or more rooms of the structure. The air diffuser includes an adjustable baffle that selectively directs air toward the first and second rooms. The air diffuser includes an acoustic dampener that prevents sound from moving through the air diffuser from one room to the next.

13 Claims, 5 Drawing Sheets

(56) References Cited

U.S. PATENT DOCUMENTS

2005/0076668 A1* 4/2005 Choi ..... B60H 1/00564
62/404
2012/0023990 A1* 2/2012 Nelson ..... F24H 4/04
62/238.7

* cited by examiner

AIR DIFFUSER OUTLET SYSTEM

PRIORITY CLAIM

The present application claims priority to U.S. Provisional Patent Application No. 61/723,380 entitled AIR DIFFUSER OUTLET SYSTEM filed Nov. 7, 2012, which is incorporated herein by reference in its entirety.

FIELD OF THE INVENTION

The present invention relates to systems and methods of distributing air from a heating, ventilation and/or air-conditioning (HVAC) system to multiple rooms from a single outlet.

BACKGROUND OF THE INVENTION

Air distribution systems in buildings such as housed office buildings, factories, stores and even certain residences include a central pressure source that moves heated or cooled air into the various rooms of the building. Each room requires a duct and an air supply diffuser, grill or register dedicated to that room. It is currently not possible to easily direct air from a single duct or air outlet into two or more rooms without adding additional ducting or some other expensive, intrusive installation.

The drawbacks of the conventional systems are many, and are made worse in installations where the walls or other partitions in the building are movable. For example in a cubicle environment where the walls are movable to accommodate different room configurations a conventional air distribution system simply cannot deliver air to the different rooms efficiently. There is a need in the art to more efficiently and accurately direct air to various rooms in a building.

SUMMARY OF THE INVENTION

The present disclosure is directed to an air distribution system. The system includes an air diffuser with an interior volume and an inlet on the diffuser coupled to an air distribution system of a structure. The structure has a first room and a second room separated by a partition. The system also has a first plenum comprising a portion of the interior volume of the air diffuser operably coupled to the receiving body and configured to receive air from the air distribution system through the receiving body and a second plenum comprising a portion of the interior volume of the air diffuser operably coupled to the receiving body and configured to receive air from the air distribution system through the receiving body. The system also has a baffle positioned in the receiving body and configured to distribute air received from the air distribution system of the structure selectively to the first plenum and second plenum in a predetermined flow ratio. The system has a first outlet coupled to the first plenum and being substantially flush with a surface of the first room, and a second outlet coupled to the second plenum and being substantially flush with a surface of the second room. Air received from the air distribution system is delivered to the first and second room according to the predefined flow ratio through the receiving body, through the first and second plenums, and through the first and second outlets.

In other embodiments, the present disclosure is directed to a method of distributing air between a first room and a second room from a single air duct. The method includes positioning an air diffuser relative to a wall separating the two rooms. The air diffuser has a single air inlet and at least two air outlets, and the two air outlets are on different sides of the wall. The method also includes directing air to the diffuser from the single air duct and directing a first portion of the air toward the first room and a second portion of the air toward the second room. The method still further includes identifying from among a plurality of the air outlets at least one air outlet positioned on a first side of the wall and at least one air outlet on a second side of the wall, and controlling the relative quantity of air flow to the first and second sides of the wall through the identified first and second air outlets.

In still further embodiments, the present disclosure is directed to an air distribution system for a structure including an air diffuser and an air inlet coupling an air duct to the air diffuser. The system also includes a first air outlet on the air diffuser and a second air outlet on the air diffuser. The air diffuser is positioned within a floor, wall, or ceiling of the structure with the first air outlet on a first side of a room partition and the second air outlet on a second side of the room partition. The system still further includes a baffle within the air diffuser configured to selectively direct air from the air inlet toward the first and second air outlets in a predefined, adjustable quantity.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
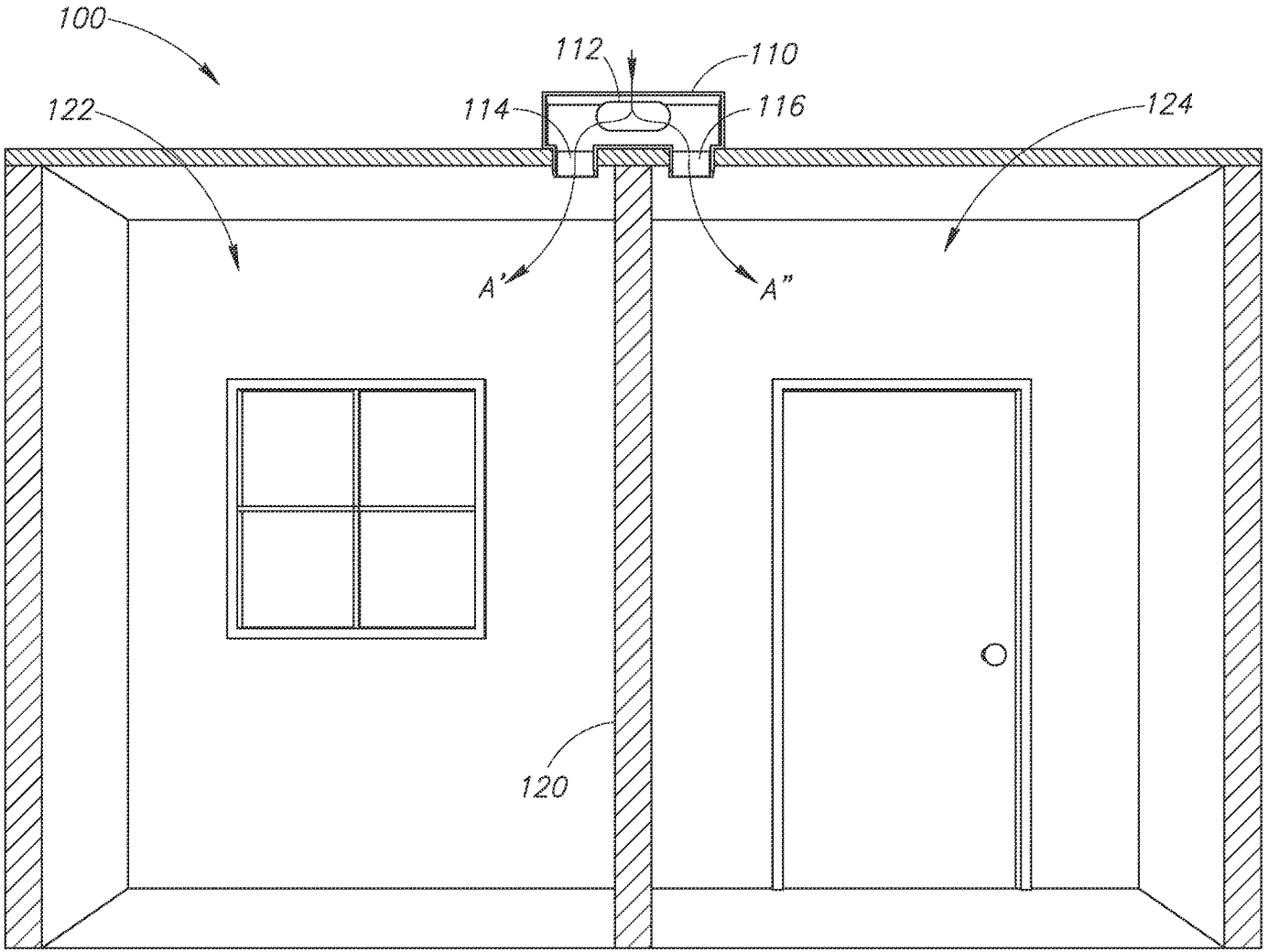
FIG. 1 shows an air distribution system including a diffuser having an air inlet, a first air outlet, and a second air outlet according to embodiments of the present disclosure.

FIG. 1 shows an air distribution system 100 including a diffuser 110 having an air inlet 112, a first air outlet 114, and a second air outlet 116. The diffuser 110 is positioned above a wall 120 separating a first room 122 from a second room 124. A HVAC unit and ducting (not shown) delivers conditioned air to the air inlet 112. The air then passes through the diffuser 110, which splits the air flow A into two components: a first component A' moving through the first air outlet 112 into the first room 122, and a second component A" moving through the second air outlet 114 into the second room 124. The diffuser 110 is adjustable manually or automatically to selectively increase or decrease the air flow to the first and second rooms.

The air flow A can be split between the first component A' and second component A" in any suitable ratio. The diffuser 110 can be configured to split the air flow A into any suitable number of components. Each of the paths defining the air flow components can be completely open, completely closed, or any intermediate position between open and closed. The number of components can correspond to the number of rooms the diffuser is configured to service. One example embodiment discussed below in greater detail is with the diffuser over a corner of four separate rooms with an air outlet for each of the four rooms. In this case the air diffuser 110 can have at least for air outlets and can be configured to split the air into at least four flow components. The separate components can be independently opened and closed, or the relationship between two or more components can be directly related.

Figure 2:
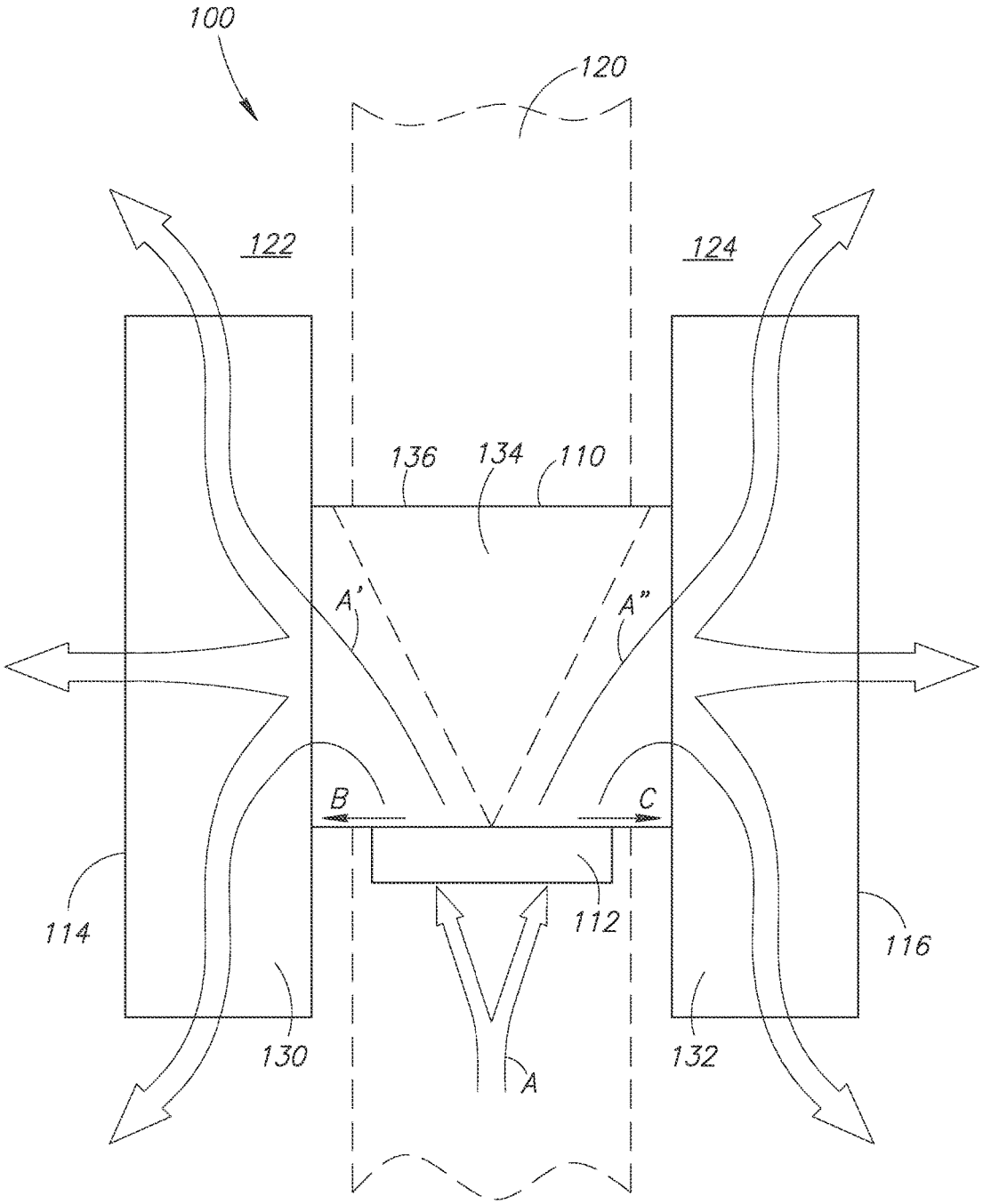
FIG. 2 is a partially schematic top view of the air distribution system according to embodiments of the present disclosure.

FIG. 2 is a partially schematic top view of the air distribution system 100 according to embodiments of the present disclosure. The wall 120, first room 122, and second room 124 are shown in phantom in relationship to the diffuser 110. The diffuser 110 includes the air inlet 112, first air outlet 114, and second air outlet 116 discussed above with respect to FIG. 1. Between the air inlet and the outlets, the diffuser 110 includes a first continuous plenum 130 leading to the first air outlet 114 and a second continuous plenum 132 leading to the second air outlet 116. The air outlets 114, 116 can match the interior surface of the rooms they service, including a mesh grate, a blank off insert, or any other suitable finish, and accommodate most diffuser blade devices available on the open market.

The diffuser 110 also includes a baffle 134 that selectively directs air into the plena in an appropriate ratio via manual or automatic control. In some embodiments the baffle 134 is a wedge-shaped member spanning the distance between the air inlet 112 and the opposite side 136 of the diffuser 110. The air flow moves in an approximate right angle from the inlet to the outlets. The baffle 134 may be adjustably movable toward and away from each plenum along arrows B and C. This movement adjusts the amount of air from the air inlet 112 that travels to the first or second plenum. The baffle 134 can be positioned near to both outlets. In some embodiments the baffle 134 is within approximately eight inches of either outlet. In embodiments in which the desired airflow to the individual rooms is to be controlled independently, the baffle 134 can be configured to open or close the air path to the first or second plenum without affecting the other air flow. For example, the baffle 134 can include separate gates for each of the first and second air plena. Each gate can be closed independently of the other. In other embodiments the air flow ratio can be zero-sum: any air flow directed away from the first plenum 130 instead reaches the second air plenum 132. In embodiments in which there are three or more air flow paths, plena, and air outlets, the ratios can also be controlled in a similar manner: either independently, or with any two or more air flow paths being controlled in a dependent manner.

The baffle 134 in combination with the structure of the diffuser 110 create a tortuous path between the first and second rooms through the diffuser 110 to prevent sound from travelling from one room to the other. In some embodiments, multiple baffles are used in series to create an even more sound-proof barrier between the rooms. Any suitable number of baffles can be used to achieve appropriate sound-proofing in a given installation. Other sound-proofing means can also be included within the diffuser 110 to further mitigate sound transmission.

The air distribution system 100 provides more accurate control over the amount of air delivered to two or more rooms of a structure. The system 100 allows a single air duct and air inlet to service multiple rooms of a structure. This is particularly useful in buildings where the walls or other partitions are movable. When the walls are in place the system 100 can selectively control the air flow to the multiple rooms, and when the walls are not in place the air distribution system 100 continues to service the space. The air distribution system 100 is rigid enough to be supported in the ceiling without the support of the wall beneath it. In other embodiments in which the system 100 is found in a wall or in the floor, the system 100 is rigid enough to stand alone within the wall or floor without extra support.

Figure 3:
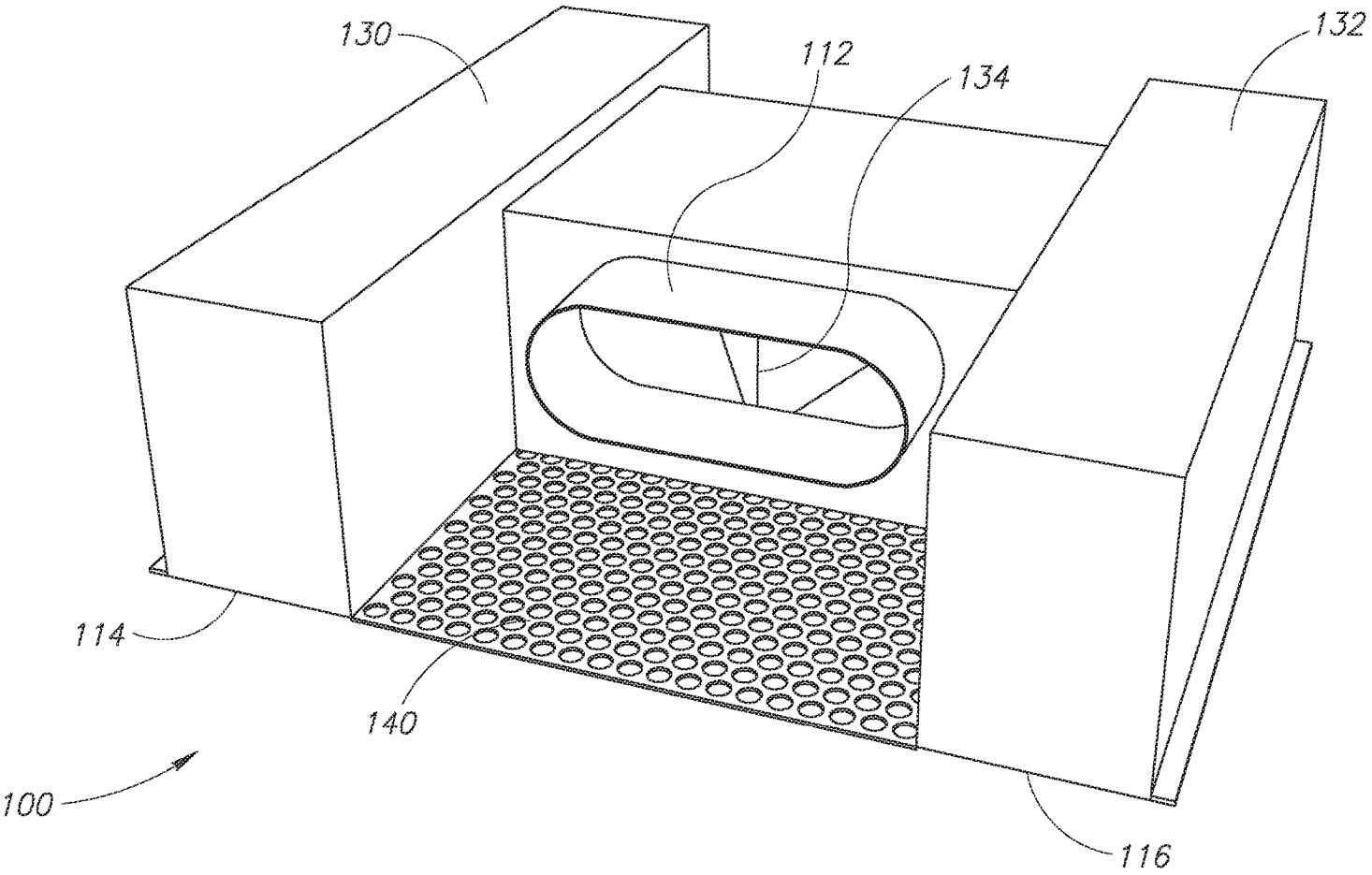
FIG. 3 is an isometric view of the air distribution system according to embodiments of the present disclosure.

FIG. 3 is an isometric view of the air distribution system 100 according to embodiments of the present disclosure. The diffuser is made of sheet metal in this embodiment; however, other suitable materials are appropriate for other embodiments. The diffuser 110 is shown with air inlet 112, air outlets 114, 116, plena 130, 132 in relationship to one another. The leading edge of the baffle 134 is visible through the opening of the air inlet 112. In this embodiment the baffle 134 is fixed; however, in other embodiments the baffle 134 or other mechanisms are adjustable to change the relative amount of air passing through each side of the diffuser 110. The air inlet 112 has rounded edges to accommodate an air duct. The shape of the air inlet 112 can change to accommodate an air duct of a different shape, for example, in preparation for installation of future walls. The system 100 also includes a mesh panel 140 between the plena 130, 132. With the diffuser 110 positioned over a wall or other room partition, the mesh panel 140 will be positioned over the wall edge. In some embodiments the air outlets 114, 116 are positioned at the corner of the wall and the ceiling, in which case the dimension of the mesh panel 140 is substantially equal to the thickness of the wall and therefore will not be visible. In other embodiments the air outlets are positioned on the ceiling partially spaced apart from the wall, in which case the mesh panel 140 will be partially visible. Accordingly, the mesh panel 140 (or any other component of the system 100 that is ultimately visible in a given installation) can be chosen to match the surrounding finish of the building. The air outlets can be sealed to the finish of the building to prevent air leakage from around the perimeter of the air outlet.

Figure 4:
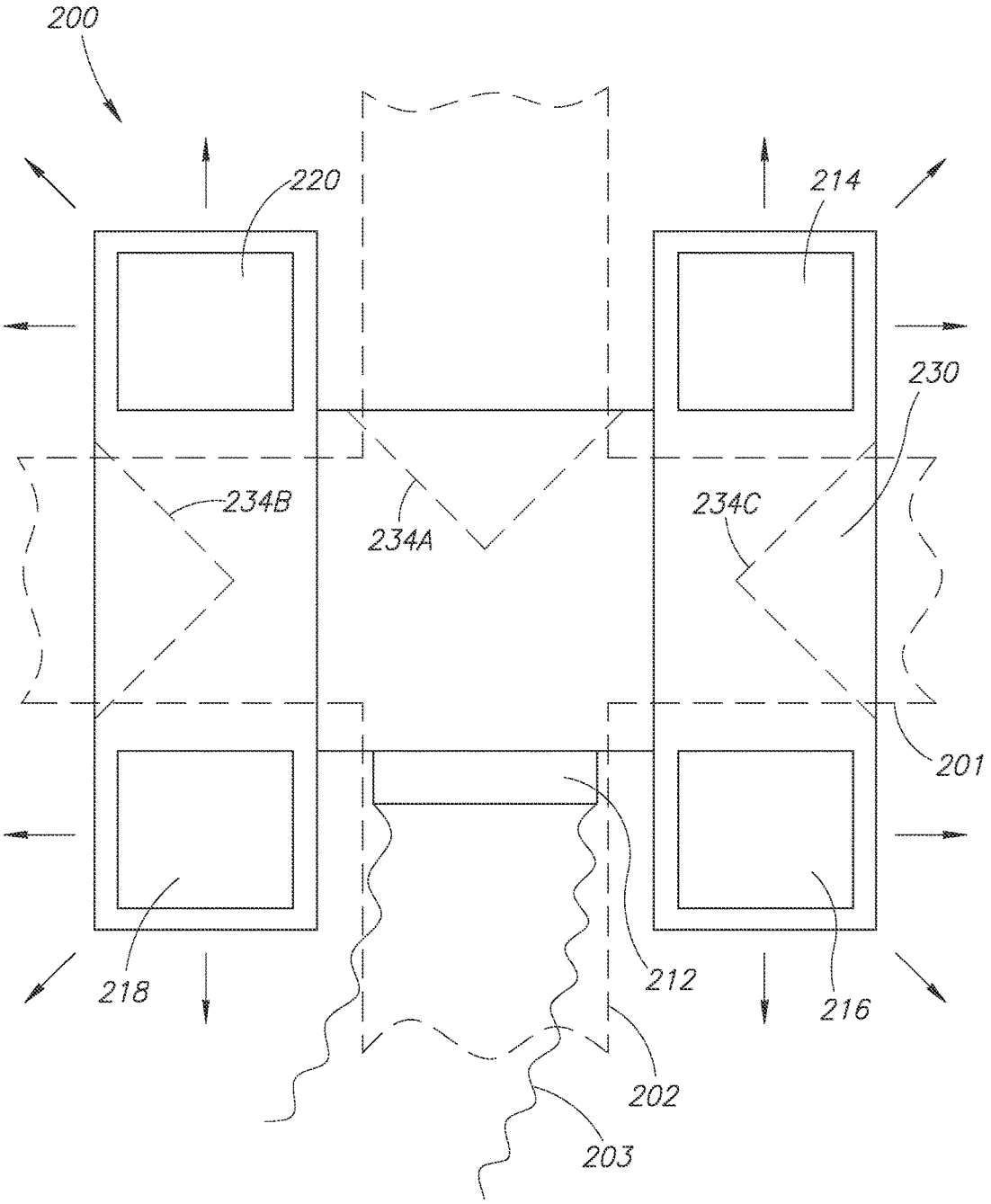
FIG. 4 is a schematic top view of an air distribution system according to embodiments of the present disclosure.

FIG. 4 is a schematic top view of an air distribution system 200 according to embodiments of the present disclosure. The system 200 includes a diffuser 210 similar to what has been previously described herein, but is configured to service four rooms of a building. The diffuser 210 is positioned at the intersection of two walls 201 and 202. The diffuser 210 includes an air inlet 212 that receives air from a duct 203, and four air outlets 214, 216, 218 and 220. Each air outlet is positioned over one of the rooms. The diffuser 210 includes a continuous air plenum 230 between the air inlet 212 and each of the air outlets. The interior volume of the diffuser 210 defines the plenum 230. The diffuser 210 also includes a baffle 234 that partitions air flow to the four rooms. The baffle 234 is configured to direct air to the four rooms in any suitable ratio. Each room can receive the full complement of air, none of the air, or some intermediate quantity of air. The baffle 234 can include a series of gates at the air outlets to control air flow independently. Alternatively, any two or more air outlets can be operated dependently whereby opening one flow path necessarily causes another flow path to close. Other, more complex variants are also possible to service any suitable number of rooms.

The adjustable baffles described above that operate to distribute air flow between the rooms serviced by the air distribution system can be controlled by a manual, mechanical lever or switch accessible from inside the serviced room. Alternatively, the baffles are controlled by remote means, such as at the thermostat or other climate control unit.

Figure 5:
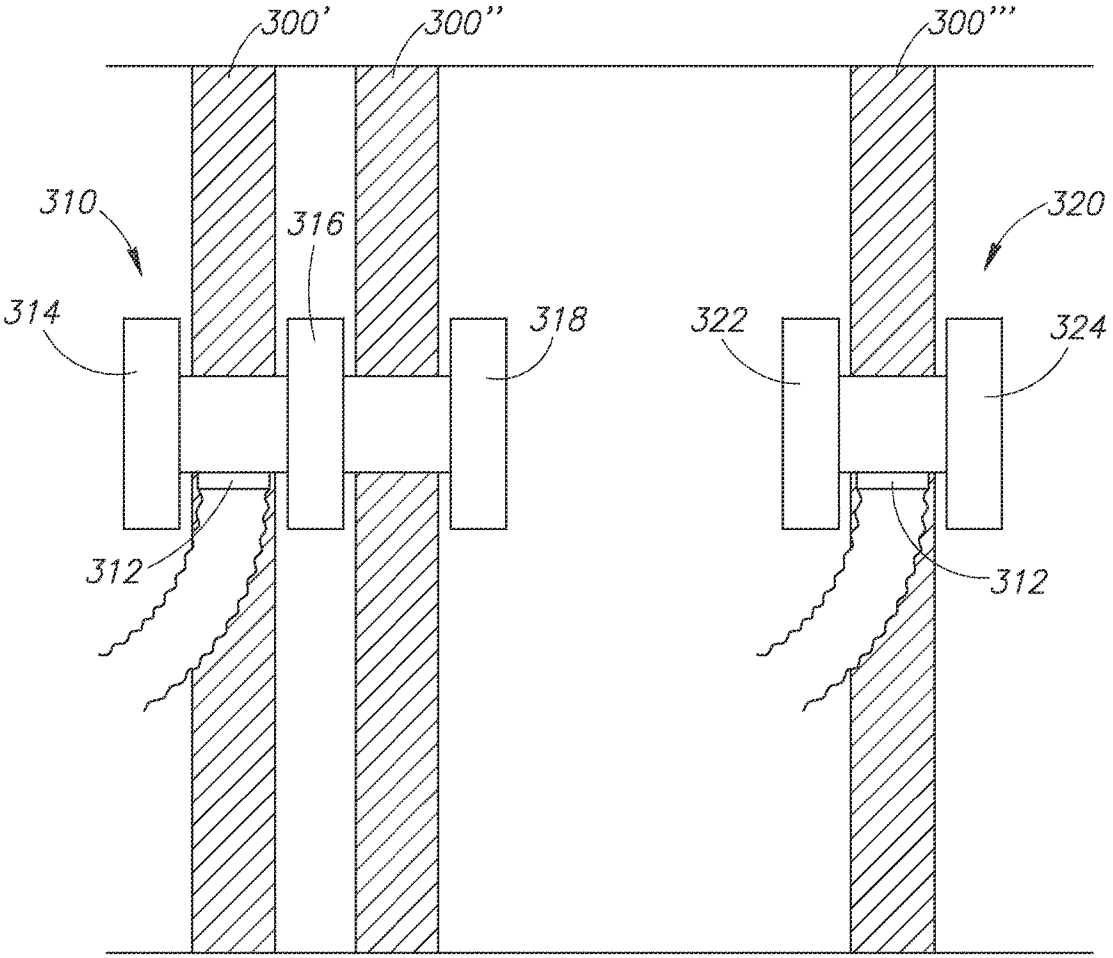
FIG. 5 is a schematic top view of a series of air diffusers according to embodiments of the present disclosure.

FIG. 5 is a schematic top view of a series of air diffusers according to embodiments of the present disclosure. In certain buildings and other structures, walls are movable to accommodate different needs of the rooms. For example, FIG. 5 depicts two rooms separated by a wall 300. The wall 300 is movable between three different positions, shown as 300' 300" and 300". Any suitable number of air diffusers can be used to accommodate the different wall positions. Also, single air diffusers with multiple outlet pairs can be used to straddle the wall in the various positions. Air diffuser 310 is shown with a single air inlet 312 and three air outlets 314, 316, and 318. When the wall 300' in the left-most position, the first and second outlets 314, 316 straddle the wall 300' and therefore can be used to service the rooms to the left and to the right of the wall in that position. The third outlet 318 may or may not be used in this circumstance, depending on the needs of the installation. When the wall is moved to the right such that the second and third outlets 316 and 318 straddle the wall 300", the second and third outlets can service the two rooms. In yet another position, to the far right, a separate air diffuser 320 straddles the wall 300'" and therefore the outlets 322 and 324 of that diffuser 320 can service the two rooms. Any suitable combination of diffusers and outlet pairs can be used to accommodate virtually any wall position.

While the preferred embodiment of the invention has been illustrated and described, as noted above, many changes can be made without departing from the spirit and scope of the invention. For example, the air distribution system can be positioned in a floor directing air upwardly into the rooms, or in a wall directing air horizontally into the rooms. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An air distribution system, comprising:

an inlet configured to be coupled to an air distribution system of a structure, the structure having a first room and a second room separated from the first room by a partition;

a receiving body comprising a front wall, a rear wall positioned opposite the front wall along a horizontal direction, a top body wall, a bottom body wall, a right opening positioned between the front wall and the rear wall at a right edge of the front wall and a right edge of the rear wall, and a left opening positioned between the front wall and the rear wall and positioned opposite the right opening at a left edge of the front wall and a left edge of the rear wall, the inlet being defined by the front wall, the top body wall and the bottom wall being offset from one another in a vertical direction;

a first plenum defining a first interior volume positioned on a left side of the receiving body having the left opening positioned between the first plenum and the front wall and rear wall of the receiving body, the first plenum including first plenum walls defining the first interior volume and extending outwardly from the front wall and the left opening along the horizontal direction and extending outwardly from the rear wall and the left opening along the horizontal direction, the first plenum walls including a first top plenum wall and a first bottom plenum wall offset from one another in the vertical direction, the first bottom plenum wall defining a first outlet, the first plenum defining a path from the receiving body to the first outlet;

a second plenum defining a second interior volume positioned on a right side of the receiving body, the right side being opposite the left side, the second plenum being positioned having the right opening between the second plenum and the front wall and rear wall of the receiving body, the second plenum including second plenum walls defining the second interior volume and extending outwardly from the front wall and the right opening along the horizontal direction and extending outwardly from the rear wall and the right opening along the horizontal direction, the second plenum walls including a second top plenum wall and a second bottom plenum wall offset from one another in the vertical direction, the second bottom plenum wall defining a second outlet, the second plenum defining a path from the receiving body to the second outlet;

a baffle positioned on the rear wall of the receiving body, the baffle configured to distribute air received from the air distribution system of the structure selectively to the first plenum and second plenum in a predetermined flow ratio, wherein the baffle is a wedge-shaped structure slidable along the rear wall between the right opening and the left opening, the baffle having a widest end positioned on the rear wall;

the first outlet being configured to direct air into the first room, wherein the first outlet is positioned offset on a first side of the partition; and the second outlet being configured to direct air into the second room, wherein the second outlet is positioned offset on a second side of the partition opposite the first side, wherein the air distribution system is configured to deliver air received by the air distribution system to the first and second room according to the predefined flow ratio through the receiving body, through the first and second plenums, and through the first and second outlets.

2. The air distribution system of claim 1 wherein the baffle is configured to adjust the flow ratio.

3. The air distribution system of claim 1 wherein:

the baffle is configured to adjust the volume of air passing through the first or second plena dependently, and opening the first plenum causes the second plenum to close and vice-versa.

4. The air distribution system of claim 1, further comprising third and fourth plena and third and fourth air outlets, wherein the first, second, third, and fourth air outlets are positioned over different rooms of the structure.

5. The air distribution system of claim 1, further comprising acoustic dampening within the air diffuser to mitigate sound transmission through the air diffuser.

6. The air distribution system of claim 1 wherein the receiving body is positioned above a ceiling of the room and the air outlets are positioned to direct air downwardly from the ceiling.

7. The air distribution system of claim 1 wherein the receiving body is positioned within a floor of the structure and the air outlets are positioned to direct air upwardly from the floor.

8. The air distribution system of claim 1 wherein the baffle is within approximately eight inches of both the first air outlet and the second air outlet.

9. The air distribution system of claim 1, wherein the baffle spans a distance between the rear wall and the front wall.

10. An air distribution system for a structure, comprising:

a receiving body comprising a front wall, a rear wall positioned opposite the front wall along a horizontal direction, a right opening positioned between the front wall and the rear wall, a left opening positioned between the front wall and the rear wall and positioned opposite the right opening, a top body wall, and a bottom body wall, the top body wall and the bottom wall being offset from one another in a vertical direction;

an air inlet coupled to the front wall;

a first air outlet coupled to the left opening;

a second air outlet coupled to the right opening, wherein the receiving body is positioned within a floor, wall, or ceiling of the structure with the first air outlet on a first side of a room partition and extending outwardly from the first side of the room partition and the second air outlet on a second side of the room partition and extending outwardly from the second side of the room partition;

a baffle within the air diffuser slidably mounted to the rear wall and configured to selectively direct air from the air inlet toward the left opening and right opening in a predefined, adjustable quantity, the baffle being positioned over the partition;

a first plenum defining a first interior volume positioned on a left side of the receiving body having the left opening positioned between the first plenum and the front wall and rear wall of the receiving body, the first plenum including first plenum walls defining the first interior volume and extending outwardly from the front wall and the left opening along the horizontal direction and extending outwardly from the rear wall and the left opening along the horizontal direction, the first plenum walls including a first top plenum wall and a first bottom plenum wall offset from one another in the vertical direction, the first bottom plenum wall defining the first air outlet; and a second plenum defining a second interior volume positioned on a right side of the receiving body, the second side being opposite the first side, the second plenum being positioned having the right opening between the second plenum and the front wall and rear wall of the receiving body, the second plenum including second plenum walls defining the second interior volume and extending outwardly from the front wall and the right opening along the horizontal direction and extending outwardly from the rear wall and the right opening along the horizontal direction, the second plenum walls including a second top plenum wall and a second bottom plenum wall offset from one another in the vertical direction, the second bottom plenum wall defining the second air outlet;

wherein the first bottom plenum wall further defines a third air outlet offset from the first air outlet;

wherein the second bottom plenum wall further defines a fourth air outlet offset from the second air outlet;

wherein the receiving body, the first plenum, and the second plenum define a single device that is mountable at an intersection of a first wall and a second wall such that:

the first air outlet is positioned on a first side of the first wall and a first side of the second wall;

the second air outlet is positioned on a second side of the first wall and a first side of the second wall, the second side of the first wall being opposite the first side of the first wall;

the third air outlet is positioned on a first side of the first wall and a second side of the second wall, the second side of the second wall being opposite the first side of the second wall;

the fourth air outlet is positioned on the second side of the first wall and the second side of the second wall.

11. The air distribution system of claim 10 further comprising means for mitigating sound transmission between the first and second sides of the partition.

12. The air distribution system of claim 10, wherein the air diffuser comprises an acoustic dampener.

13. The air distribution system of claim 10, further comprising a single mesh panel covering both the first air outlet and the second air outlet such that the single mesh panel spans across the room partition and is a bottom surface of the air distribution system.

* * * * *